United States Patent [19]

Najibi

[11] 4,131,817

[45] Dec. 26, 1978

[54] SPARK PLUG POWER ENHANCER

[76] Inventor: Nassir Najibi, 2827 W. Jerome St., Chicago, Ill. 60645

[21] Appl. No.: 820,422

[22] Filed: Aug. 1, 1977

[51] Int. Cl.[2] ..... H01T 13/46

[52] U.S. Cl. ..... 313/124; 313/130

[58] Field of Search ..... 313/123, 124, 130, 118, 313/137

[56] References Cited

U.S. PATENT DOCUMENTS

| | | | |
|---|---|---|---|
| 1,200,663 | 10/1916 | Smith, Jr. | 313/124 |
| 1,331,029 | 2/1920 | Rummell | 313/124 |
| 1,423,219 | 7/1922 | Hutchinson | 313/124 |
| 1,506,823 | 9/1924 | Francoeur | 313/123 |
| 3,229,153 | 1/1966 | Freeman, Jr. | 313/123 |

FOREIGN PATENT DOCUMENTS

| | | | |
|---|---|---|---|
| 477899 | 4/1938 | United Kingdom | 313/124 |

*Primary Examiner*—John Kominski

*Attorney, Agent, or Firm*—Merriam, Marshall & Bicknell

[57] ABSTRACT

A spark plug power enchancer for internal combustion engine comprises a secondary spark gap produced between spaced electrodes separated by a dielectric material formed of a sea shell.

4 Claims, 3 Drawing Figures

SPARK PLUG POWER ENHANCER

The present invention relates to a spark enhancer for use in the ignition circuit of an internal combustion engine.

BACKGROUND OF THE INVENTION

Many proposals have been made for enhancing the spark produced by a spark plug in an internal combustion engine by providing one or more secondary or auxiliary spark gaps in the electrical circuit leading to the primary or firing gap of the plug. Among the disclosures of auxiliary spark gaps of this type are U.S. Pat. Nos. Re. 14,957; 738,922; 1,093,744; 1,164,082; 1,200,663; 1,423,219; 1,518,248; 1,729,576; 1,893,204; and 2,260,399. It has been found that use of an auxiliary or secondary gap increases the intensity of the spark produced by the spark plug, thereby tending to overcome the adverse effects of carbon or oil which may exist in the vicinity of the firing gap of the spark plug. Accordingly, the spark plug fires more reliably, resulting in improved economy, smoother running, easier starting, and increased spark plug life.

In the devices heretofore known, a wide variety of arrangements for producing the secondary spark has been employed, including spaced pointed electrodes providing an air gap, flat opposed electrodes separated by a solid or perforated mass of dielectric material, individual washers of dielectric material, and various combinations thereof. In the cases where a dielectric material is used to separate the opposed electrodes between which the secondary spark is produced, it has been proposed to use porcelain, mica, glass or similar dielectric material which has a high resistance to the flow of electricity and which can withstand the localized high temperatures produced by the spark which is created.

In accordance with the invention, there is provided a spark enhancer, which in one embodiment is built integrally into a conventional spark plug, and in another embodiment is adapted to be inserted in the high tension line leading from the distributor or ignition coil to the spark plug, in which a novel, superior dielectric material is used in place of the materials heretofore used for this purpose. Specifically, it has been found that marine shells, i.e., the hard outer shells of marine animals such as marine snails and bivalves, possess an unexpectedly superior combination of properties for use as the separation insulators between the electrodes forming the secondary spark gap. Marine shells of this type are resistant to high temperatures, they are sufficiently electrically non-conductive to permit a spark to be formed between two electrodes separated by and in contact with the shell, and they appear to be electrically conducting to a small extent, sufficient to modify the spark which is formed in a manner which produces superior results, when compared with other dielectric materials which have been used for the same purpose.

The invention will be better understood from the following detailed description theref, taken in conjunction with the accompanying drawings, in which.

Figure 1:
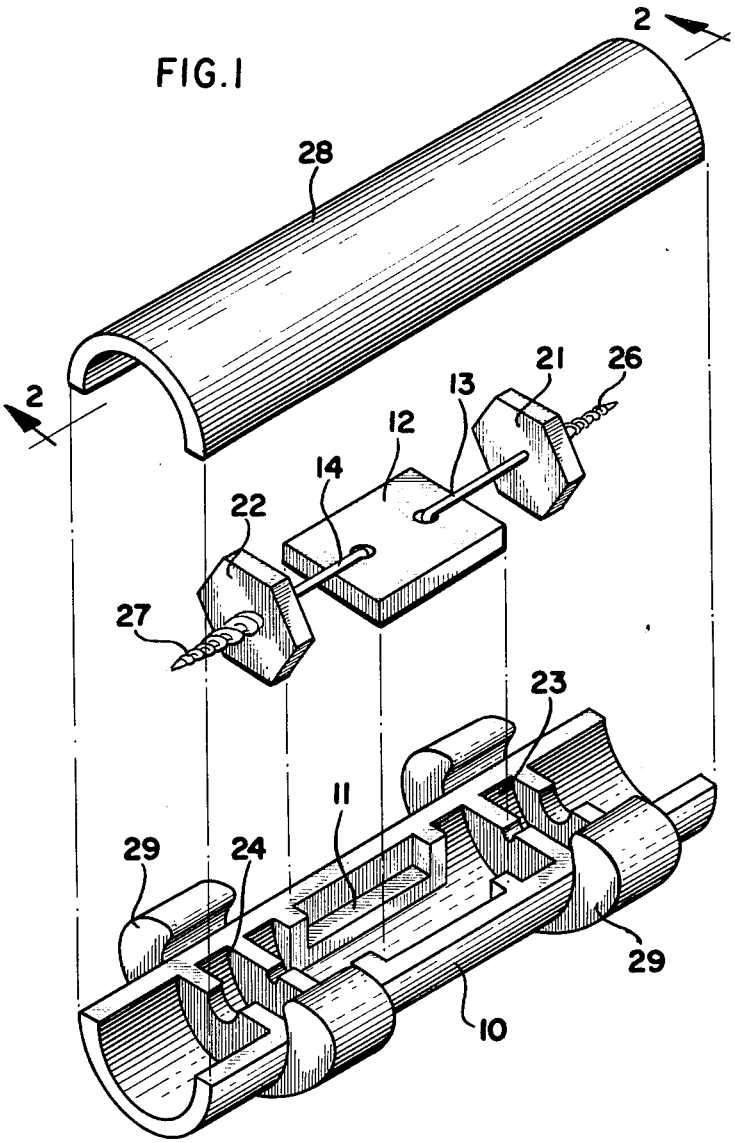
FIG. 1 is an exploded view of a spark enhancer assembly intended for use in the high tension line leading from the distributor to a conventional spark plug.

In the embodiment shown in FIG. 1, elongated, generally hollow body 10 is formed of an electrically insulating material, suitably a synthetic plastic. Since this embodiment can be installed in any portion of the high tension line circuit, away from the heat of the combustion chamber, the material of which the body is formed need not be extremely heat-resistant. As shown, body 10 is formed with an interior having a recess 11 adapted to receive and hold separation block 12 which is formed of a marine shell in accordance with the invention. First and second electrodes 13 and 14, both formed of copper, brass, or other suitable electrically conducting material, have bent ends 16, 17 which are inserted into holes 18, 19 provided in separation block 12. To the ends of first and second electrodes 13 and 14 are attached strain-relief discs 21 and 22, which are received in suitably shaped recesses 23 and 24 in body 10. Attached to the outer faces of discs 23, 24 are electrically conducting screws 26, 27 which are electrically connected with first and second electrodes 13 and 14 respectively. Although discs 21 and 22 need not be electrically conducting for purposes of the invention, it will probably be found most convenient to form the assembly consisting of an electrode, e.g., 13, a disc, e.g., 21 and a screw, e.g., 26 as an integral unit made of an electrically conducting material such as copper or brass, preferably plated with a corrosion resistant material such as chromium. In any event, it is essential that each of screws 26 and 27 be electrically connected to the electrode with which it is associated.

Figure 2:
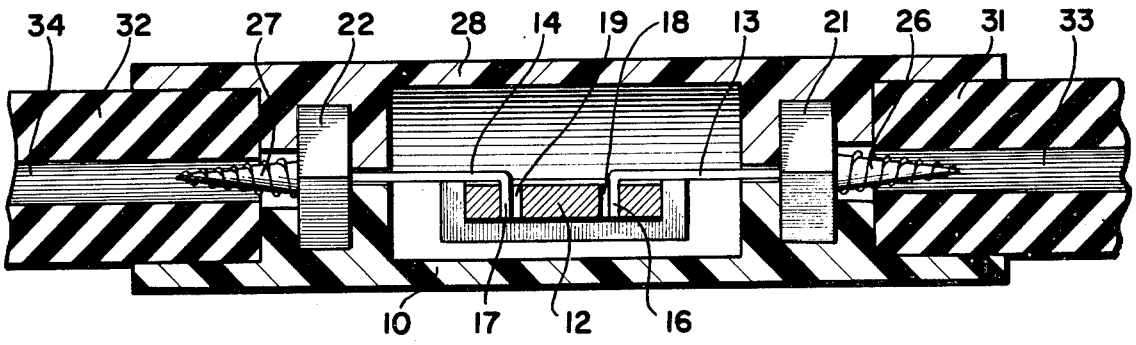
FIG. 2 is a cross-sectional view, along the line 2—2 of FIG. 1, of the apparatus of FIG. 1 in an assembled condition.

As shown in FIG. 2, cover 28 is internally provided with recesses similar to those in body 10 for accepting and holding separator block 12, and electrodes 13 and 14 attached thereto. For ease in assembling the embodiment of FIG. 1, it is convenient to provide body 10 with resilient integral clamps 29 which snap over cover 28 and maintain the assembly in the condition shown in FIG. 2.

For use in a high tension circuit of a conventional internal combustion engine, conventional ignition wire 31, 32 is inserted into each end of the assembly of FIG. 2, with the conductors 33, 34 of the ignition wires engaging and in electrical contact with screws 26 and 27 respectively.

Figure 3:
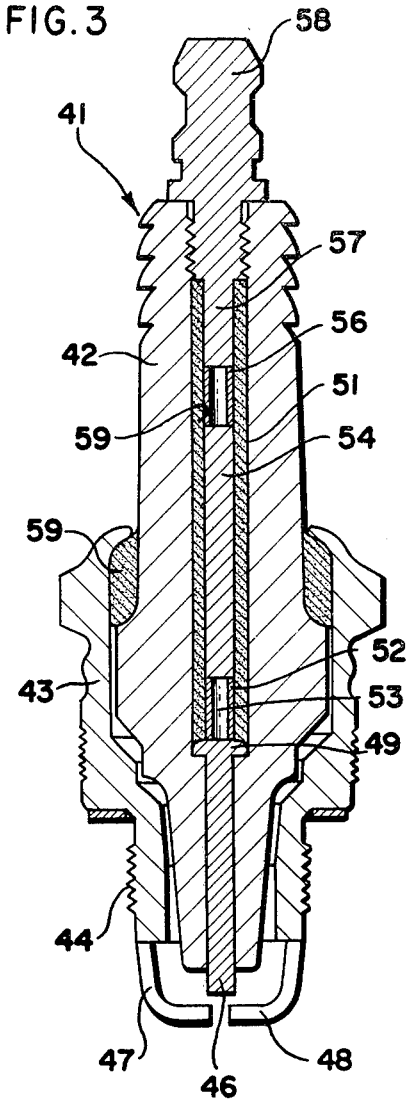
FIG. 3 is a cross-sectional view of an otherwise conventional spark plug in which the spark enhancer assembly of the invention is formed within the insulator of the spark plug.

FIG. 3 shows in cross-section an alternative embodiment of the invention, comprising a spark plug 41 including a conventional ceramic insulator 42 and a conventional metallic body 43 provided with screw threads 44, by means of which the spark plug is held in position with its lower end protruding into the combustion chamber of an engine.

The firing gap of spark plug 41 comprises in conventional fashion a center electrically conducting electrode 46 and one or preferably two outer electrodes 47, 48 electrically connected to body 43 of the plug. The upper end of center electrode 46 terminates in a flattened button 49 above which there exists an elongated bore 51 in insulator 42. In direct contact with button 49 is a separation cylinder 52 formed of marine shell and provided with a central longitudinal bore 53. The upper end of separation cylinder 52 is in contact with a second electrode shaft 54, the upper end of which is in electrical contact with a second, optional separation cylinder 56 similar to that (52) in contact with its lower end. The upper end of second separation cylinder 56 is in electrical contact with a third electrode shaft 57, the upper end of which terminates in a conventional spark plug head 58 to which a high tension lead is attached in a conventional fashion. The space between the shoulders of metal body 43 and insulator 42, as well as the clearance space between bore 51 and electrode shafts 54 and 57 and separation cylinders 52 and 56, is suitably filled with a conventional sealing material 59 which is electrically insulating and capable of withstanding the operating temperature of the spark plug.

The distance between the opposed electrodes, i.e., 16 and 17 or 54 and 49 established by the separation block or cylinder must be such that a spark can be created between the electrodes by the ignition system of the engine. Further, it is preferred that a direct air gap exist between the electrodes. Such an air gap is provided by bore 53 in cylinder 52, and by the flat face of block 12 along which electrodes 13 and 14 extend.

In a typical embodiment for use in conventional automobiles, each of separation cylinders 52 and 56 is suitably 4.5–5 mm in length, with an outer diameter of about 3.0 mm and a central bore about 1.8 mm in diameter. In the embodiment shown in FIG. 1, the separation block is suitably about 9.5 mm wide, about 12.7 mm long, and about 1.6 mm thick, with a separation between the electrodes of about 6.4 mm.

The preferred separation material used in the present invention comprises the shells of marine snails, such as conch shells, as well as those of bivalves including oysters, clams, scallops and the like. In order to permit the separation cylinder and block to have the dimensions previously given, the shells must be of a relatively large size, i.e., with a minimum thickness on the order of 1.5 mm for forming the separation block and 4–5 mm for forming separation cylinders.

Although the reasons for the superiority in performance of the marine shells used in the invention, as compared with conventional dielectric materials such as porcelain, mica, glass and the like, are not known and do not per se form any portion of the invention, the superiority in performance of the marine shells has been demonstrated. The power enhancer of the invention, employing the marine shell material as the insulation spacer, provides faster starts, smoother running, improved mileage, and increased spark plug life with less maintenance between replacements. In addition, deposits in the cylinders and intake manifold, and on the valves of the engine are reduced.

The foregoing detailed description has been given for clearness of understanding only and no unnecessary limitations should be understood therefrom, as modifications will be obvious to those skilled in the art.

What is claimed:

1. A spark enhancer for internal combustion engines comprising:

a first electrode adapted to be electrically connected to the ignition coil of a spark ignition system;

a second electrode spaced from the first electrode and adapted to be electrically connected to the firing gap of a spark plug;

a spark modifying separation element in contact with both of said first and second electrodes and holding said electrodes in a spaced relationship, said element including provision for an air gap between said electrodes;

said spark modifying element being formed of a natural material comprising a marine shell.

2. The enhancer of claim 1 wherein said shell is that of a marine snail or bivalve.

3. A spark enhancer in accordance with claim 1 wherein said first and second electrodes are included within the insulating body of a spark plug, said spark modifying element being a cylinder having a central longitudinal bore aligned with the longitudinal axes of said first and second electrodes.

4. A spark enhancer in accordance with claim 1 in which said spark modifying element is a block provided with spaced transverse holes into which said first and second electrodes are inserted.

* * * * *